US005592273A

United States Patent [19]

Yamamoto

[11] Patent Number: 5,592,273

[45] Date of Patent: Jan. 7, 1997

[54] PHOTOCONDUCTIVE DRUM AND TRANSFER APPARATUS FOR AN IMAGE FORMING APPARATUS

[75] Inventor: Keiji Yamamoto, Kanagawa, Japan

[73] Assignee: Fuji Xerox Co., Ltd., Tokyo, Japan

[21] Appl. No.: 515,619

[22] Filed: Aug. 16, 1995

[30] Foreign Application Priority Data

Aug. 18, 1994 [JP] Japan ..... 6-194419

[51] Int. Cl.$^6$ ..... G03G 15/00; G03G 15/14

[52] U.S. Cl. ..... 399/126; 399/159; 399/297

[58] Field of Search ..... 355/271, 277, 355/274

[56] References Cited

U.S. PATENT DOCUMENTS

| | | | |
|---|---|---|---|
| 4,862,214 | 8/1989 | Kasahara et al. | 355/277 |
| 4,965,310 | 10/1990 | Harris et al. | 524/406 |
| 4,977,297 | 12/1990 | Squire | 174/258 |
| 5,220,387 | 6/1993 | Tsunoda et al. | 355/274 |
| 5,250,994 | 10/1993 | Ito et al. | 355/271 |

FOREIGN PATENT DOCUMENTS 58-50564 3/1983 Japan .

*Primary Examiner*—Arthur T. Grimley

*Assistant Examiner*—Sophia S. Chen

*Attorney, Agent, or Firm*—Finnegan, Henderson, Farabow, Garrett & Dunner, L.L.P.

[57] ABSTRACT

The image forming apparatus of the present invention includes a photoconductive drum, a transfer apparatus and a position adjusting apparatus. The photoconductive drum has a photoconductive-drum-sided gear and a photoconductive-drum-sided positioning cylindrical surface at an outer peripheral portion. The transfer apparatus includes a transfer drum and a transfer drum supporting shaft for rotatably supporting the transfer drum. The transfer drum has a pair of drums each having a transfer-sided positioning cylindrical surface at an outer peripheral portion thereof; a drum coupling member for integrally coupling the pair of drums with each other under a predetermined separated distance; and a transfer-sided gear which is provided on an outer peripheral of one of the pair of drums which has both the transfer-sided gear and the transfer-sided positioning cylindrical surface being integrally formed by an amorphous thermoplastic resin. The position adjusting apparatus for positioning the transfer drum close to, or apart from the photoconductive drum by swinging the transfer drum supporting shaft. When the transfer drum is positioned close to the photoconductive drum, the transfer-sided gear is meshed with the photoconductive-drum-sided gear, and the transfer-sided positioning cylindrical surface is abutted to the photoconductive-drum-sided positioning cylindrical surface.

9 Claims, 7 Drawing Sheets

PHOTOCONDUCTIVE DRUM AND TRANSFER APPARATUS FOR AN IMAGE FORMING APPARATUS

BACKGROUND OF THE INVENTION

1. Field of the Invention

The present invention relates to a transfer drum of an image forming apparatus used when a toner image formed on a photoconductive drum of an image forming apparatus such as a copying machine and a printer is transferred to a transfer material such as a recording sheet.

2. Description of the Related Art

One of conventional transfer drums is shown in FIGS. 12 and 13. In FIG. 13, the cylindrical photosensitive portions 12 is provided at a center portion of the photosensitive drum 101 along the shaft direction. The photosensitive gear 103 is provided on one end portion of the shaft direction (left end portion in FIG. 13).

The transfer drum 106 is used to transfer the toner image formed on the cylindrical photosensitive portion 102 of this photosensitive drum 101 to the transfer material. The transfer drum 106 is so arranged that this transfer drum 106 is movable between a position (saving position) apart from the photosensitive drum 101 and another position (operating position) close thereto.

The transfer roller 106 includes a front drum 107, a rear drum 108, and a drum tie-plate 109 for coupling the front and rear drums 107 and 108. They are made of aluminium. Cylindrical members 111 and 112 for supporting bearings are fixed at center portions of both drums 107 and 108. A shaft member 113 is supported on the cylindrical members 111 and 112 via a bearing (not shown). This shaft member 113 are extended outwardly from both drums 106 and 107 (see FIG. 12) and is supported by a frame (not shown) of an image forming apparatus.

A transfer film 114 (see FIG. 13) is spread in a cylindrical shape between both drums 107 and 108, and then a transfer material such as paper and a recording sheet (not shown) adheres to this cylindrical transfer film 114 by means of static electricity.

In FIGS. 12 and 13, a ring-shaped driven gear 116 is mounted on the left end portion of the front drum 107 of the transfer drum 106. The ring-shaped driven gear 116 meshes with a photosensitive side gear 103 of the photosensitive drum 101. A ring-shaped rubber belt 117 is mounted on the right side of this transfer-sided gear 116. As shown in FIG. 13, this rubber belt 117 is attached to the cylindrical surface of the photosensitive drum 101, so that an interval (DDS dimension, see FIG. 13) between the surface of the photosensitive drum portion 102 and the surface of the transfer film 114 is maintained at a predetermined value.

Although the transfer-sided gear is not provided with the rear drum 108, a rubber belt 118 (see FIG. 12) similar to the ring-shaped rubber belt 117 is provided therewith.

A tolerance of an outer diameter required for the transfer drum 106 is selected with in the range of ±0.02 mm in a monochromatic toner image forming apparatus, namely rather high precision. Therefore, conventionally, the front drum 107, rear drum 108, drum tie-plate 109, and transfer-sided gear 116 and the like are made of aluminium, and are processed by cutting machines in order to ensure the dimensional precision.

As a result, the number of working steps for mounting the transfer-sided gear 116 on the front drum 107 and for cutting the above-described members has to be increased, and therefore it is rather difficult to lower the manufacturing cost.

Further, Unexamined Japanese Patent Publication No. Sho. 58-50564 discloses the method for manufacturing all of the front drum, rear drum, and drum tie-plate by way of a resin integral form (molding).

However, the method described in Unexamined Japanese Patent Publication No. Sho. 58-50564 has the following problem. Generally, as described in the above publication, it is well known that the material of the molding member is changed from the metal material into the resin material. However, in the case that either strength or precision is required for the molding member, a certain improvement should be required. When the overall transfer drum is molded by the resin as disclosed in the publication, in such a transfer apparatus that a transfer film is spread on a transfer drum, it is difficult to ensure precision in alignments of a front drum and rear drum which constitute important dimension in an image forming apparatus. Also, mechanical strength such as deflection and torsion is also important in view of the structure of this transfer drum. As to the molding members requiring such high precision and high strength, it is practically not possible to ensure such requirements even by employing any types of resin materials. In practically, it is impossible to manufacture the entire transfer drum by using a resin.

Except the idea disclosed in the publication, conventionally, the transfer drums having the structures indicated in FIGS. 12 and 13 is practically used. To ensure the desired high precision of one pair of drums for constituting the transfer drum, the molding product of aluminium is processed by the cutting tool. This type of practically available transfer drum would require high cost by performing the cutting work.

In the drum having the transfer-sided gear and the transfer-sided positioning cylinder surface among one pair of drums (front drum and rear drum) for constituting the transfer drum, the drum base member corresponding to this constructive element, the transfer-sided gear mounted on the outer peripheral portion, the ring-shaped rubber belt for constructing the transfer-sided positioning cylindrical surface, and the sensor shielding plate are separately constructed. The reason why this drum is constructed of the separate members is to ensure the precision. Unless such a separate construction is employed, it is conceived that the desired precision would not be easily obtained.

The drum having the transfer-sided gear and the transfer-sided positioning cylinder surface at the outer peripheral portion would require the work to manufacture the respective elements (drum base member, transfer-sided gear, ring-shaped rubber, and sensor shielding plate) separately constructed, and the work to assemble these separate elements, resulting in high cost.

SUMMARY OF THE INVENTION

It is an object of the present invention to provide an image forming apparatus having a transfer drum in which the manufacturing time of the transfer drum is shortened and also manufacturing cost thereof is lowered.

The image forming apparatus of the present invention includes a photoconductive drum, a transfer apparatus and a position adjusting apparatus. The photoconductive drum has a photoconductive-drum-sided gear and a photoconductive-drum-sided positioning cylindrical surface at an outer peripheral portion. The transfer apparatus includes a transfer drum and a transfer drum supporting shaft for rotatably supporting the transfer drum. The transfer drum has a pair of drums each having a transfer-sided positioning cylindrical surface at an outer peripheral portion thereof; a drum coupling member for integrally coupling the pair of drums with each other under a predetermined separated distance; and a transfer-sided gear which is provided on an outer peripheral of one of the pair of drums which has both the transfer-sided gear and the transfer-sided positioning cylindrical surface being integrally formed by an amorphous thermoplastic resin. The position adjusting apparatus for positioning the transfer drum close to, or apart from the photoconductive drum by swinging the transfer drum supporting shaft. When the transfer drum is positioned close to the photoconductive drum, the transfer-sided gear is meshed with the photoconductive-drum-sided gear, and the transfer-sided positioning cylindrical surface is abutted to the photoconductive-drum-sided positioning cylindrical surface.

In the image forming apparatus having the above-described feature according to the present invention, since the drum having the transfer-sided gear and the transfer-sided positioning cylindrical surface is formed by an amorphous thermoplastic resin in an integral form, the drum having necessary precision can be obtained without performing the cutting work. In addition, under such a condition that the transfer drum is located close to the photosensitive drum, the transfer-sided gear is meshed with the photosensitive-drum-sided gear, and also the transfer-sided positioning cylindrical surface is abutted to the photosensitive-drum-sided positioning cylindrical surface. As a result, the photosensitive drum and the transfer drum can be rotated with keeping a predetermined positional relationship in the synchronization mode.

BRIEF DESCRIPTION OF THE DRAWINGS

In the accompanying drawings.

PREFERRED EMBODIMENT OF THE INVENTION

The preferred embodiment of the present invention will be described referring to the accompanying drawing as follows, however, the present invention is not limited to the below-mentioned embodiment.

Figure 1:
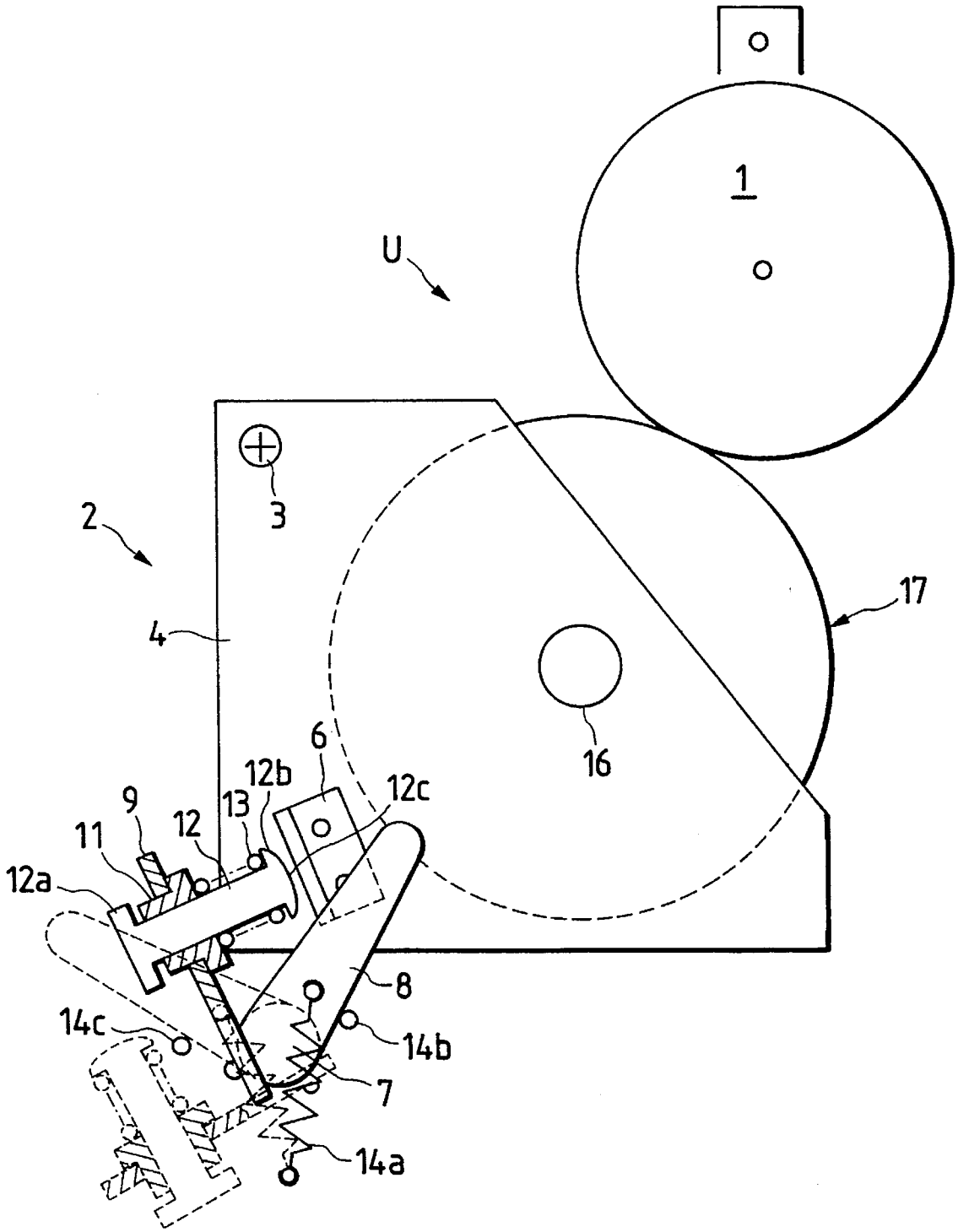
FIG. 1 is an explanatory diagram showing a major portion of an image forming apparatus according to an embodiment of the present invention.
Figure 13:
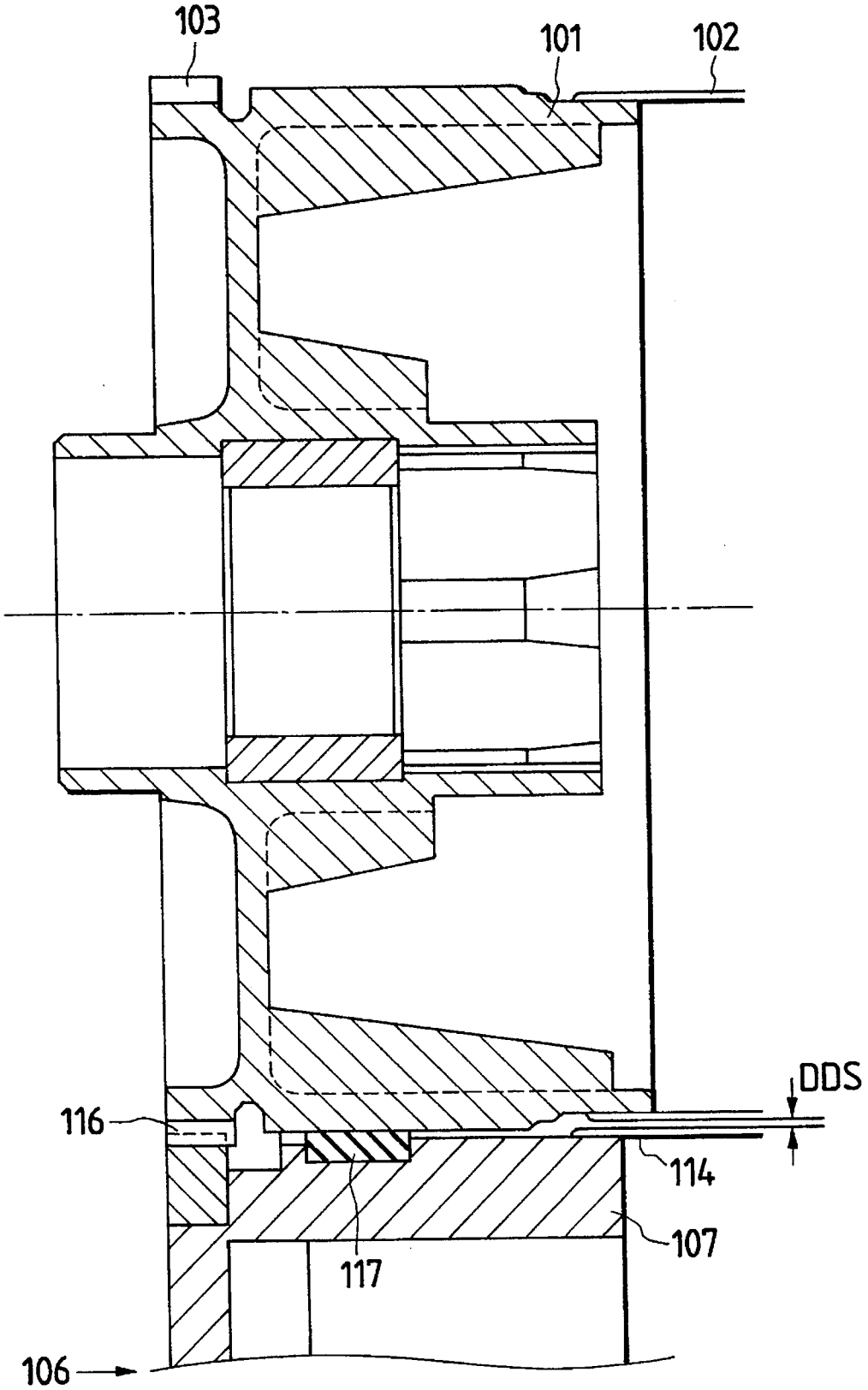
FIG. 13 is a diagram showing a relationship between a transfer drum and a photosensitive drum.

In FIG. 1, an image forming apparatus U has a photosensitive drum 1. This photosensitive drum 1 is arranged in a similar manner to that of the conventional photosensitive drum shown in FIG. 13.

A transfer apparatus 2 positioned adjacent to the photosensitive drum 1 is supported by a frame (not shown) of the image forming apparatus. The transfer apparatus 2 has a swinging center shaft 3 located parallel to the shaft of the photosensitive drum 1 and also a swing member 4 freely swung around the swinging center shaft 3. The swing member 4 is arranged on both end portions of the swinging center shaft 3 along the shaft direction (namely, direction perpendicular to paper surface), and is constructed of a polygonal-shaped plate like member. An L-shaped bracket 6 is fixed on the respective outer side surfaces of one paired swing member 4 by way of such a fixing member as a bolt and a nut.

An operation shaft 7 which is positioned adjacent to the L-shaped bracket 6 and also parallel to the shaft of the photosensitive drum 1 is rotatably supported by the frame (not shown) of the image forming apparatus U. An operation lever 8 is fixed on one end of this operation shaft 7. This operation lever 8 is rotatably operated, so that the operation shaft 7 can be rotated.

To this operation shaft 7, each of abutting member supporting levers 9 is fixed in correspondence with the respective L-shaped bracket 6. A cylindrical guide tube 11 is fixed on the tip portion of the abutting member supporting lever 9. A columnar abutting member 12 is slidably supported to the guide tube 11. A large diameter stopper **12*a* is formed at a base edge portion (namely, a portion located opposite to the L-shaped bracket 6) of this abutting member 12, whereas a spring washer 12*b* is formed at a tip portion thereof (a portion near the L-shaped bracket 6). Then, a tip surface of the spring washer 12*b* forms such an abutting portion 12*c* abutting to the L-shaped bracket 6**.

A compression spring (elastic member) 13 is arranged between the spring washer **12*b* and the abutting member supporting lever 9**.

When the operation lever 8 is rotated along the right direction, this operation lever 8 is held at a position (operation position) as indicated by a solid line in FIG. 1 by way of a tension spring **14*a* and a stopper 14*b*. When the operation lever 8 is rotated along the left direction, this operation lever 8 is held at another position (save position) indicated by a dot and dash line in FIG. 1 by way of the tension spring 14*a* and a stopper 14*c*. Under such a state (being held at the operation position) as indicated by the solid line of FIG. 1, the abutting portion 12*c* of the abutting member 12 is abutted to the L-shaped bracket 6, and then the compression spring 13 is compressed between the abutting member supporting lever 9 and the spring washer 12*b*. In other words, the abutting member supporting lever 9 fixed on the operation shaft 7 urges the swing member 4 via the abutting member 12 around the swing shaft 3 along the counterclockwise direction. Further, the above-described abutting member supporting lever 9, operation shaft 7, and operation lever 8 are urged by the reaction of the compression spring 13 along the counterclockwise direction in FIG. 1. However, since the tension spring 14***a* has a stronger spring force than that of the compression spring 13, the operation lever 8 is held at the position indicated by the solid line of FIG. 1.

As the member for holding the operation lever 8 at the solid line position (operation position) and also at the position (save position) indicated by the dot/dash line, other member than the tension spring 14*a* and the stoppers 14*b*, 14*c* may be employed. For instance, this member may be constructed of such an engage member which is slidable between an engaging position abutting against the upper side edge of the operation lever 8 indicated by a solid line of FIG. 1, and an engaged position where the operation lever 8 is freely rotatable. This engage member can hold the operation lever 8 at the solid line position of FIG. 1 by blocking the rotation of the operation lever 8 along the counterclockwise direction at the above-described engage position (namely, a position abutting against the upper side edge of the operation lever 8 at the solid line position of FIG. 1).

A transfer drum supporting shaft 16 of the transfer apparatus 2 is fixed and supported by the above-described one pair of swing members 4. Then, the transfer drum 17 is rotatably supported by this transfer drum supporting shaft 16.

A position adjusting apparatus is constructed of the elements indicated by the above-mentioned reference numbers 4 to 13, by which the transfer drum 17 rotatably supported on the transfer drum supporting shaft 16 is located close to, or apart from the photosensitive drum 1 by swinging the transfer drum supporting shaft 16 of the transfer apparatus.

With reference to FIGS. 2 to 11, the transfer drum 17 rotatably supported by the transfer drum supporting shaft 16 will be explained.

Figure 2:
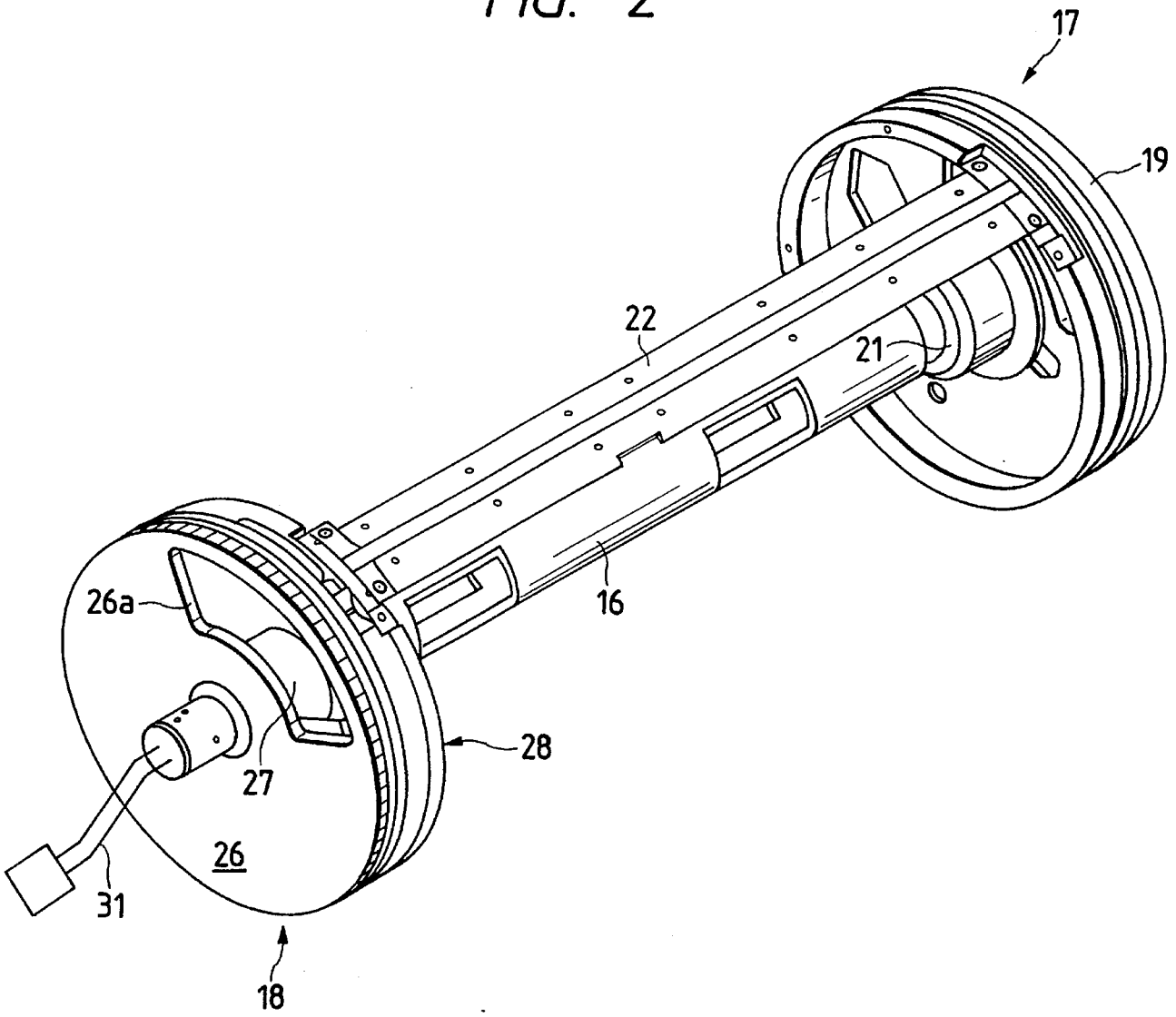
FIG. 2 is a perspective view indicating a transfer drum used in this embodiment.
Figure 3:
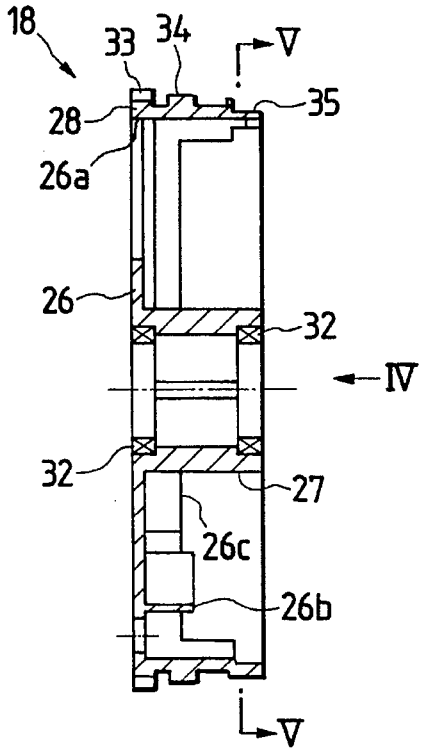
FIG. 3 is a sectional view showing a front drum of a constructive element of the transfer drum used in the embodiment, and corresponds to a sectional view, taken along a line III—III of FIG. 4.

In FIG. 2, a front drum 18 corresponding to the structural element of the transfer drum 17 is supported via a bearing (will be explained later) to one end portion of the transfer drum supporting shaft 16, and a rear drum 19 is supported via a bearing 21 (will be discussed in detail) to the other end portion. Then, both of these front and rear drums 18 and 19 are coupled to each other by way of a drum tie-plate 22.

Referring to FIG. 2 to FIG. 5, the front drum 18 will be explained. The front drum 18 is formed from an amorphous thermoplastic resin in an integral form. For example, the amorphous thermoplastic resin is polyarylate, polysulfone, polyetherimide, polyamideimide, polyethersulfone or the like.

The front drum 18 has a circular plate portion 26, a central hub portion 27 and a cylindrical outer peripheral portion 28. In a circular plate portion 26, a notch portion 26*a* having a proper shape is formed. A center portion of the central hub portion 27 extends along an inner direction in the center portion of the front drum 18 (namely, right direction as viewed in FIG. 3). An outer peripheral portion of the cylindrical outer peripheral portion 28 extends along the inner direction (right direction as viewed in FIG. 3).

Figure 4:
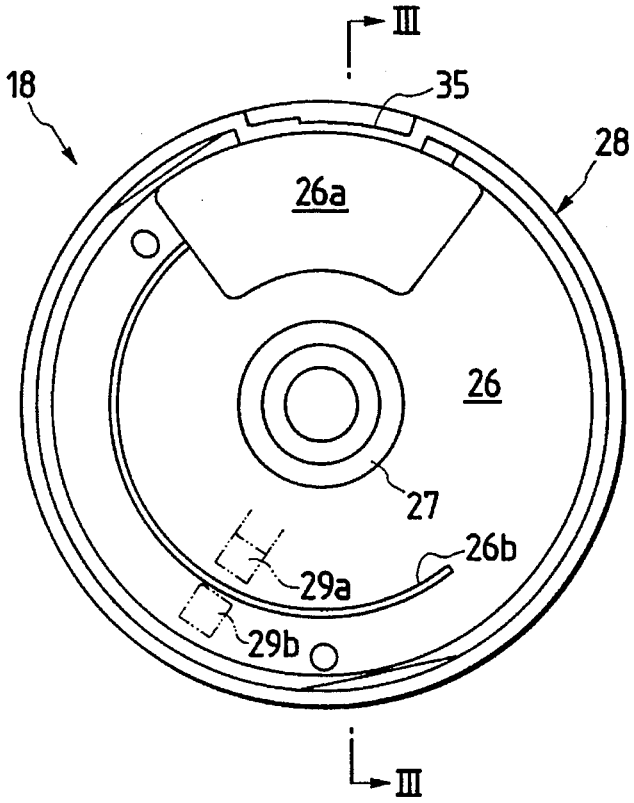
FIG. 4 is a view as seen from an arrow IV of FIG. 3.
Figure 5:
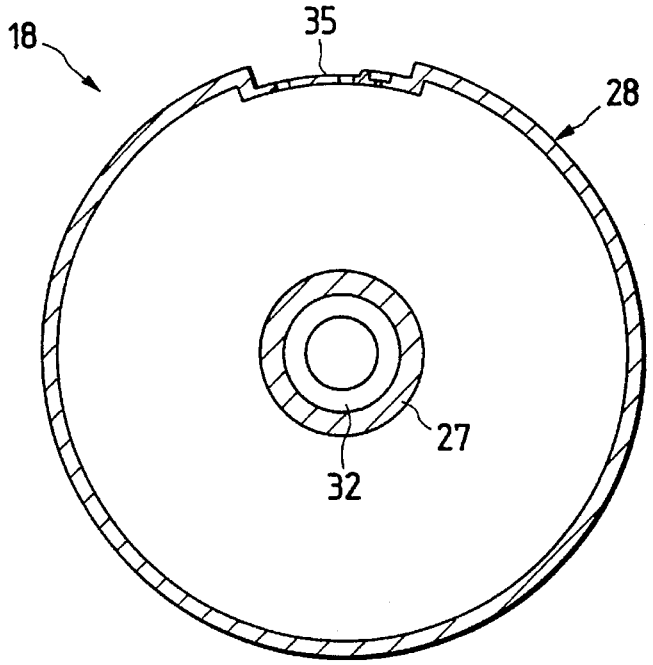
FIG. 5 is a sectional view, taken along a line V—V of FIG. 3.
Figure 6:
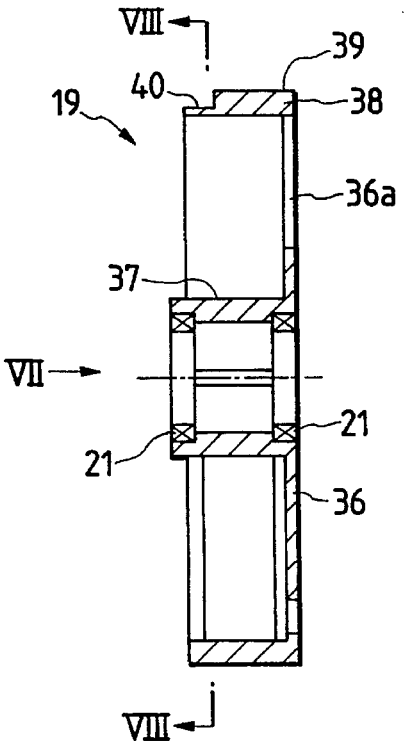
FIG. 6 is a sectional view showing a rear drum corresponding to the constructive element of the transfer drum used in this embodiment.
Figure 7:
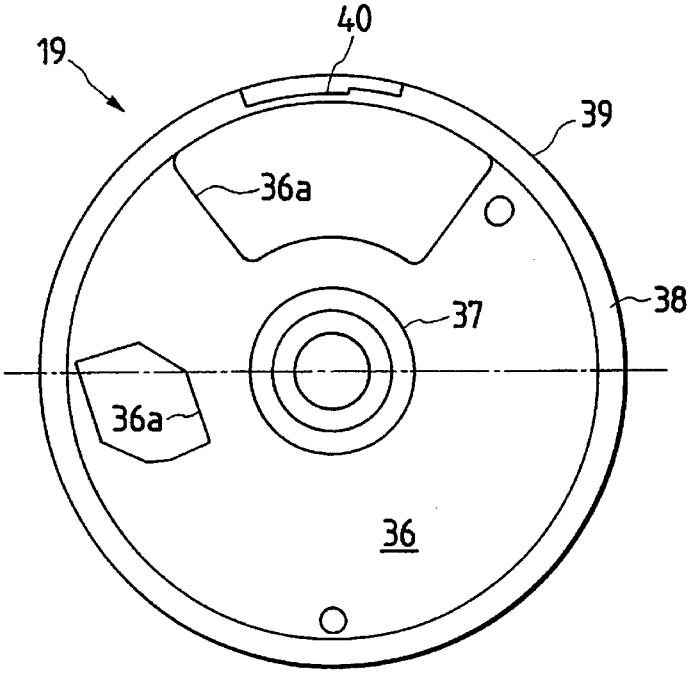
FIG. 7 is a view as seen from an arrow VII of FIG. 6.
Figure 8:
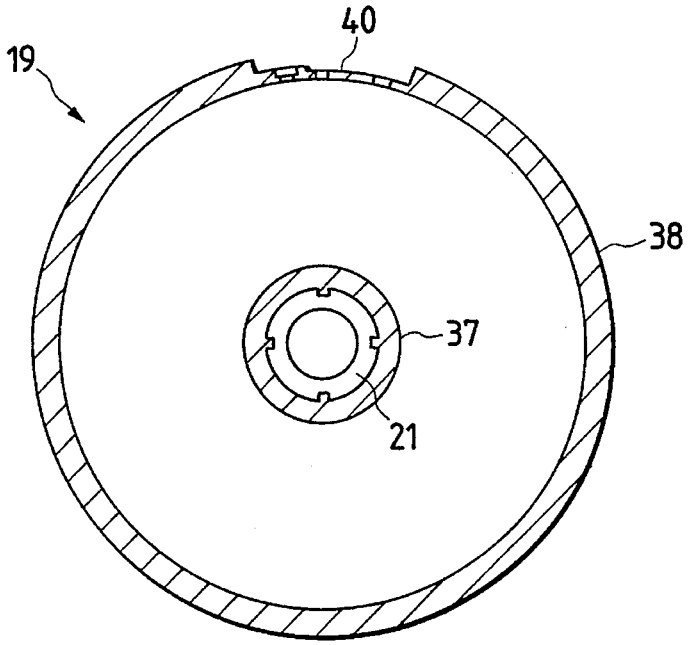
FIG. 8 is a sectional view, taken along a line VIII—VIII of FIG. 6.
Figure 9:
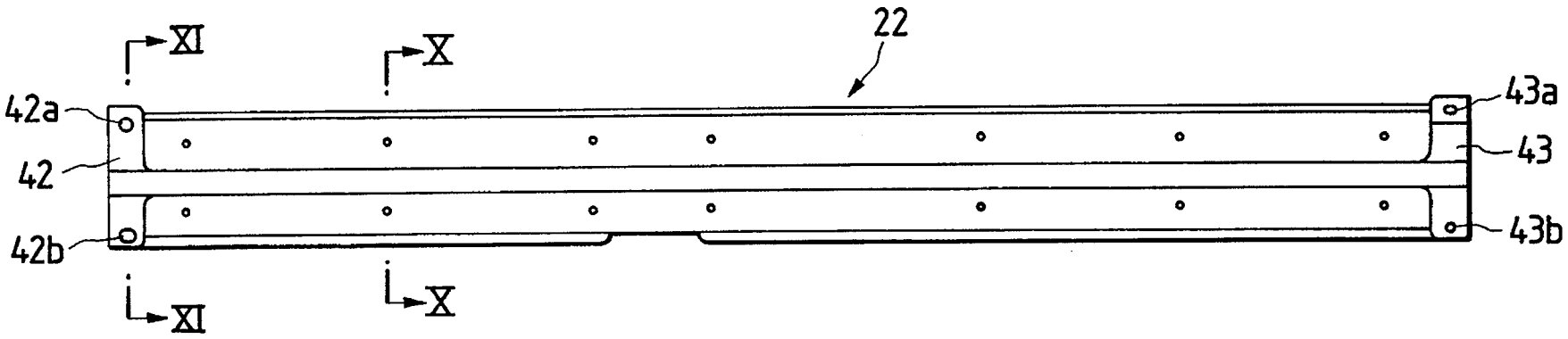
FIG. 9 is a sectional view for indicating a drum tie-plate corresponding to the constructive element of the transfer drum used in this embodiment.
Figure 11:
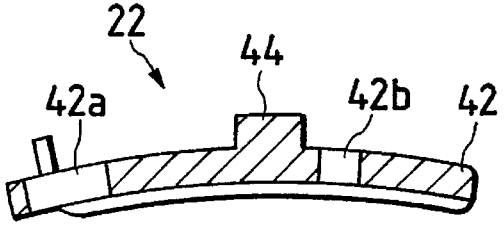
FIG. 11 is an enlarged sectional view, taken along a line XI—XI of FIG. 9.

A light shielding wall 26*b* for detecting a rotation position and a rib 26*c* for adjusting a thickness of the wall during the molding are provided along a circumference of the inner side surface (namely, right side surface in FIG. 3) of the circular plate portion 26. In FIG. 4, a light emitting element 29*a* and a light receiving element 29*b*, which are positioned on both sides of the light shielding wall 26*b*, as indicated by a two-dotted/dash line, are fixed on the transfer drum supporting shaft (namely, a shaft for rotatably supporting the transfer drum 18). These light emitting/receiving elements 29*a* and 29*b* are used to detect the rotation position of the transfer drum 17. A power supplying conductor to the light emitting element 29*a*, and a conducting member 31 (see FIG. 3) such as a signal output line of the light receiving element 29*b* are extended through the inner portion of the transfer drum supporting shaft 16 and through the transfer drum 17.

Bearings 32 (see FIG. 3) are mounted in the both end portions (namely, right and left end portions of FIG. 3) of the center hub portion 27 of the front drum 18 along the shaft directions thereof.

On the cylindrical outer peripheral portion 28 of the front drum 18, there are fabricated a gear (transfer-sided gear) 33 meshed with the gear (not shown) of the photosensitive drum 1, a transfer-sided positioning cylindrical surface 34 abutting against a positioning cylindrical surface (not shown) of the photosensitive drum 1, and a concave 35 for coupling the tie-plate.

With reference to FIG. 2 and FIGS. 6 to 8, the rear drum 19 will now be described.

The rear drum 19 is formed of the amorphous thermoplastic in an integral form similarly to the front drum 18.

The rear drum 19 has a circular plate portion 36, a central hub portion 37 and a cylindrical outer peripheral portion 38. In the circular plate portion 36, a notch portion 36*a* having a proper shape is formed. The central hub portion 37 extends along an inner direction (namely, left direction as viewed in FIG. 6). An outer peripheral portion of the cylindrical outer peripheral portion 38 extends along the inner direction (left direction as viewed in FIG. 3).

The bearings 21 (see FIGS. 2 and 6) are mounted in the both end portions (namely, right and left end portions of FIG. 3) of the center hub portion 37 of the rear drum 19 along the shaft directions thereof.

On the cylindrical outer peripheral portion 38 of the rear drum 19, there are fabricated a transfer-sided positioning cylindrical surface 39 abutting against a positioning cylindrical surface (not shown) of the photosensitive drum 1, and a concave 40 for coupling the tie-plate.

The drum tie-plate 22 will now be explained with reference to FIG. 2 and FIGS. 9 to 11.

The drum tie-plate 22 is such a member for coupling integrally the front drum 18 and the rear drum 19, and has a function to support the respective drums 18 and 19, and also a transfer film (not shown). A coupling portion 42 with the front drum 18 is provided on one end portion of the drum tie-plate 22, and another coupling unit 43 with the rear drum 19 is provided on the other end portion thereof. As apparent from FIG. 11, the coupling portions 42 and 43 provided on the both end portions of this drum tie-plate 22 are fabricated in such a manner that portions of the lower side are deleted and are made thinner than the central portion thereof.

Screw through holes 42*a*, 42*b*, and 43*a*, 43*b* for coupling the drum tie-plate 22 with the front drum 18 and the rear drum 19 are provided on the coupling portions 42 and 43.

Figure 10:
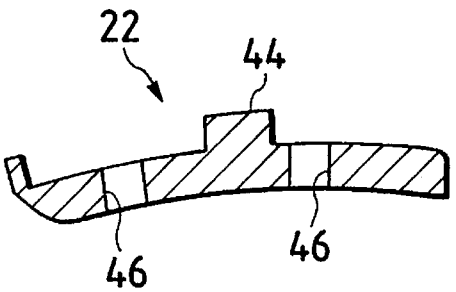
FIG. 10 is an enlarged sectional view, taken along a line X—X of FIG. 9.
Figure 12:
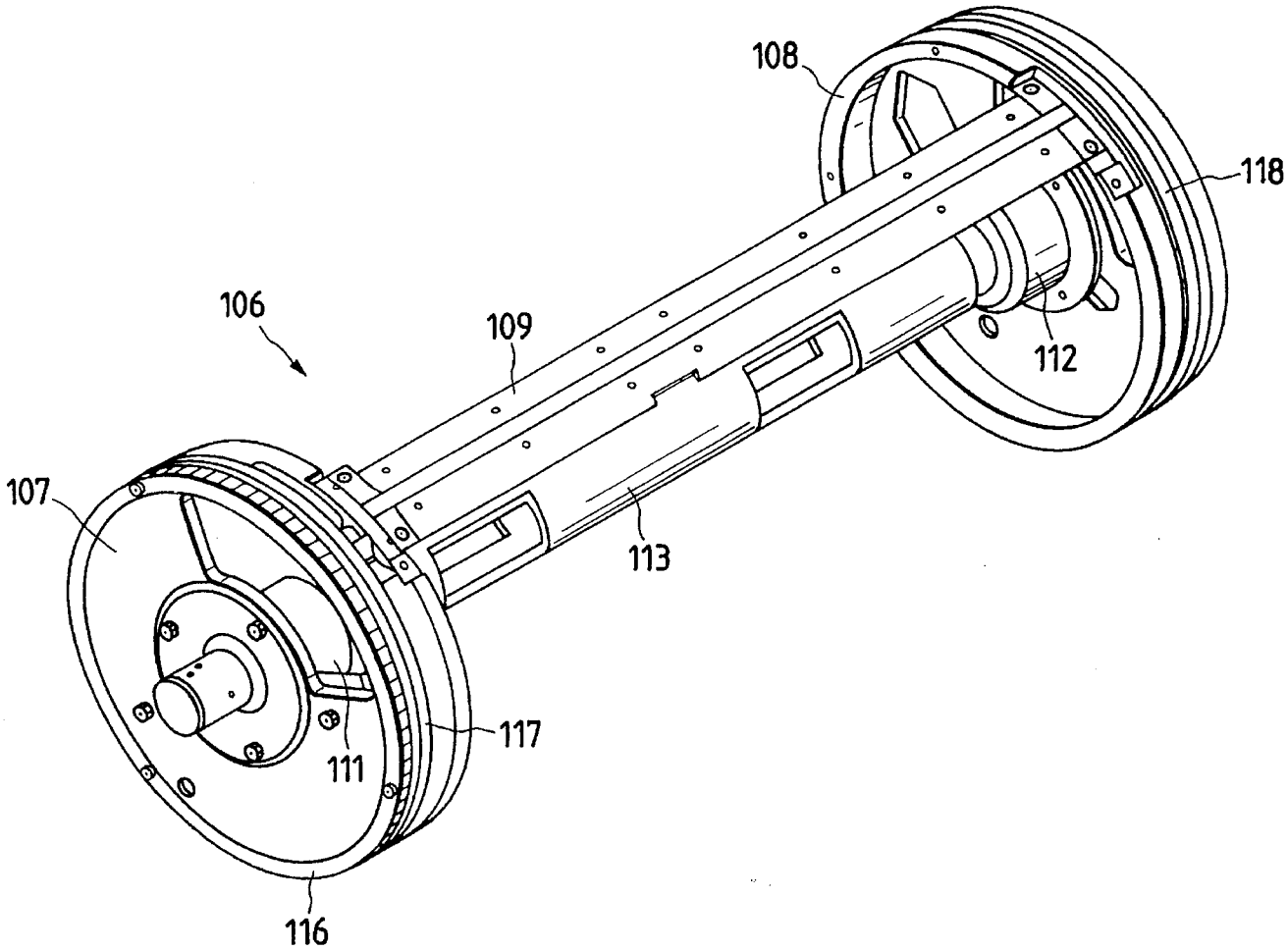
FIG. 12 is an explanatory perspective view showing a conventional transfer drum.

Also, a projection 44 extending along the longitudinal direction of the drum tie-plate 22 is formed at a center portion along the transverse direction. In FIG. 10, portions of the projection 44, whose height is made lower than that of the projections 44 at both ends, correspond to portion for fixing a transfer film (member for supporting transfer materials such as recording sheets and paper, not shown in the drawing), and own a screw hole 46 for fixing the transfer film.

Next, effects of the above-described embodiments will now be explained.

In the image forming apparatus having the feature according to the present invention, the front drum 18, the rear drum 19, and the drum tie-plate 22, which correspond to the constructive element of the transfer drum 17, are fabricated in an integral form. In particular, since the front drum 18 having the transfer-sided gear 33 and the transfer-sided positioning cylindrical surface 34 is formed by the amorphous thermoplastic resin in an integral form, the front drum (namely, drum having transfer-sided gear and transfer-sided positioning cylindrical surface) 18 with the necessary precision can be obtained without performing the cutting work. Since this front drum 18, the rear drum having the transfer-sided positioning cylindrical surface 39, and the drum tie-plate 22 for integrally coupling these front and rear drums are employed, the transfer drum 17 can be manufactured at low cost.

In the position adjusting apparatus constructed of the elements shown in the reference numerals 4 to 13, the operation lever 8 is rotated between the position indicated by the solid line of FIG. 1 and the position indicated by the dot/dash line of FIG. 1, so that the transfer drum 17 can be positionally controlled to the operation position (namely, position close to the photosensitive drum 1) and the save position (position apart from photosensitive drum 1).

That is to say, one pair of swing member 4 of the position adjusting apparatus for supporting the transfer drum supporting shaft 16 is supported to the frame of the image forming apparatus, and also is swung around the swing center shaft 3 positioned parallel to the transfer drum supporting shaft 16. The operation shaft 7 rotatably supported to the frame of the image forming apparatus and located parallel to the swing center shaft 3 is rotated by rotatably operating the operation lever 8.

The abutting portion 12*c* of the abutting member 12 supported via the compression spring (elastic member) 13 to the operation shaft 7 is abutted to the swing member 4 in response to the rotation position of the operation shaft 7, thereby swinging the swing member 4. Under such a condition that the abutting portion 12*c* is abutted to the swing member 4 to swing the swing member 4 (namely, under such a state that the operation lever 8 is located at the position indicated by the solid line of FIG. 1), the transfer drum 17 is moved to the position (operation position) close to the photosensitive drum 1, and also under such a condition that the abutting portion 12*c* is not abutted to the swing member 4, but the swing member 4 is freely swung by the gravity force, the transfer drum 17 is moved to the position (save position) apart from the photosensitive drum 1.

Then, when the transfer drum 17 is at the operation position, the transfer-sided positioning cylindrical surfaces 34 and 39 of the transfer drum 17 are depressed to a positioning cylindrical surface (not shown) of the photosensitive drum 1 under predetermined depression force (i.e., depression force corresponding to reaction force of compression spring 13). Under this condition, the transfer-sided gear 33 is meshed with the photosensitive-drum-sided gear (not shown). As a consequence, both of the photosensitive drum 1 and the transfer drum 17 are rotatably driven in the synchronization mode with keeping a predetermined positionalship.

Since the drum tie-plate 22 is made of the resin, instead of aluminium as in the conventional tie-plate, in the embodiment, there is no need to prevent the leakage problems caused by the high tension voltage corotron provided inside the transfer drum 17.

While the embodiments of the present invention have been described in detail, the present invention is not limited thereto, but may be modified within the technical scope and spirit of the present invention. Modified embodiments of the present invention will now be exemplified.

The photosensitive-drum-sided gear may be similarly made of the amorphous thermoplastic resin as in the transfer-sided gear. The resin's hardness of the photosensitive-drum-sided gear may be selected to be lower than that of the transfer-sided gear. In this case, the transfer-sided gear may have a longer lifetime, as compared with that of the photosensitive-drum-sided gear. As a consequence, when the photosensitive drum is replaced and at the same time, the photosensitive-drum-sided gear is replaced, since the lifetime of the transfer-sided gear still remains, the transfer drum need not be replaced.

The above-described sheet processing apparatus of the present invention can achieve the following advantages.

The manufacturing time of such a drum can be shortened and the manufacturing cost thereof can be lowered. This drum has the transfer-sided gear and the transfer-sided positioning cylindrical surface, among one pair of drums for constituting the transfer drum used in the image forming apparatus.

When one pair of drums for constituting the transfer drum used in the image forming apparatus, and also the drum coupling member for coupling these drums are integrally formed by the amorphous thermoplastic resin, respectively, it could be realized that the manufacturing time of the transfer drum can be considerably shortened, and the manufacturing cost thereof can be considerably lowered.

What is claimed is:

1. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface.

2. An image forming apparatus as claimed in claim 1, wherein the other drum paired with said drum having both said transfer-sided gear and said transfer-sided positioning cylindrical surface, and said drum coupling member are integrally formed by the amorphous thermoplastic resin, respectively.

3. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, a drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface; and wherein said transfer-sided gear is formed of a resin whose hardness is higher than that of said photosensitive-drum-sided gear.

4. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, a drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface;

wherein the other drum paired with said drum having both said transfer-sided gear and said transfer-sided positioning cylindrical surface, and said drum coupling member are integrally formed by the amorphous thermoplastic resin, respectively; and wherein said transfer-sided gear is formed of a resin whose hardness is higher than that of said photosensitive-drum-sided gear.

5. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, a drum coupling member for integrally coupling said pair of drums with each other at a predetermined separated distance, and a transfer-side gear positioned at an outer periphery of at least one of said pair of drums; and a position adjusting apparatus for positioning said transfer drum close to, or apart from said photoconductive drum by moving said transfer drum supporting shaft;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface;

wherein said position adjusting apparatus comprises:

a swing member supported by a frame of said drum and transfer apparatus, for supporting said transfer drum supporting shaft and swinging around a swinging center shaft positioned parallel to said transfer drum supporting shaft;

an operation shaft rotatably supported by the frame of said image forming apparatus and positioned parallel to said swinging center shaft;

an operation lever for rotating said operation shaft; and an abutting portion supported by said operation shaft via an elastic member and abutted to said swinging member in accordance with the rotation position of the operation shaft to swing said swinging member; and further, wherein a position of said swinging center shaft is arranged in such a manner that under a condition that said abutting portion is abutted to the swing member to swing the swing member, said transfer drum is moved close to said photoconductive drum, and under a condition that the swing member is freely swung by gravity force without abutting said abutting portion to the swing member, said transfer drum is moved apart from said photosensitive drum.

6. A photoconductive drum add transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising pair of drums each having a transfer-sided positioning cylindrical surface at an outer peripheral portion thereof, a drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft;

wherein both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface;

wherein said position adjusting apparatus comprises:

a swing member supported by a frame of said drum and transfer apparatus, for supporting said transfer drum supporting shaft and swinging around a swinging center shaft positioned parallel to said transfer drum supporting shaft;

an operation shaft rotatably supported by the frame of said image forming apparatus and positioned parallel to said swinging center shaft;

an operation lever for rotating said operation shaft; and an abutting portion supported by said operation shaft via an elastic member and abutted to said swinging member in accordance with the rotation position of the operation shaft to swing said swinging member;

wherein a position of said swinging center shaft is arranged in such a manner that under a condition that said abutting portion is abutted to the swing member to swing the swing member, said transfer drum is moved close to said photoconductive drum, and under a condition that the swing member is freely swung by gravity force without abutting said abutting portion to the swing member, said transfer drum is moved apart from said photosensitive drum; and wherein said transfer-sided gear is formed of a resin whose hardness is higher than that of said photosensitive-drum-sided gear.

7. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, a drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft comprising;

a swing member supported by a frame of said image forming apparatus, for supporting said transfer drum supporting shaft and swinging around a swinging center shaft positioned parallel to said transfer drum supporting shaft;

an operation shaft rotatably supported by the frame of said image forming apparatus and positioned parallel to said swinging center shaft;

an operation lever for rotating said operation shaft; and an abutting portion supported by said operation shaft via an elastic member and abutted to said swinging member in accordance with the rotation position of the operation shaft to swing said swinging member;

wherein both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface;

wherein the other drum paired with said drum having both said transfer-sided gear and said transfer-sided positioning cylindrical surface, and said drum coupling member are integrally formed by the amorphous thermoplastic resin, respectively; and wherein a position of said swinging center shaft is arranged in such a manner that under a condition that said abutting portion is abutted to the swing member to swing the swing member, said transfer drum is moved close to said photoconductive drum, and under a condition that the swing member is freely swung by gravity force without abutting said abutting portion tot he swing member, said transfer drum is moved apart from said photosensitive drum.

8. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion thereof, a drum coupling member for integrally coupling said pair of drums with each other at a predetermined separated distance, and a transfer-sided gear positioned at an outer periphery of at least one of said pair of drums; and a position adjusting apparatus for positioning said transfer drum close to, or apart from said photoconductive drum by moving said transfer drum supporting shaft comprising:

a swing member supported by a frame of said image forming apparatus, for supporting said transfer drum supporting shaft and swinging around a swinging center shaft positioned parallel to said transfer drum supporting shaft;

an operation shaft rotatably supported by the frame of said image forming apparatus and positioned parallel to said swinging center shaft;

an operation lever for rotating said operation shaft; and an abutting portion supported by said operation shaft via an elastic member and abutted to said swinging member in accordance with the rotation position of the operation shaft to swing said swinging member;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface;

wherein the other drum paired with said drum having both said transfer-sided gear and said transfer-sided positioning cylindrical surface, and said drum coupling member are integrally formed by the amorphous thermoplastic resin, respectively;

wherein a position of said swinging center shaft is arranged in such a manner that under a condition that said abutting portion is abutted to the swing member to swing the swing member, said transfer drum is moved close to said photoconductive drum, and under a condition that the swing member is freely swung by gravity force without abutting said abutting portion tot he swing member, said transfer drum is moved apart from said photosensitive drum; and wherein said transfer-sided gear is formed of a resin whose hardness is higher than that of said photosensitive-drum-sided gear.

9. A photoconductive drum and transfer apparatus for an image forming apparatus comprising:

a photoconductive drum having a photoconductive-drum-sided gear and a photoconductive-drum-sided positioning cylindrical surface at an outer peripheral portion thereof;

a transfer apparatus including a transfer drum and a transfer drum supporting shaft for rotatably supporting said transfer drum, said transfer drum comprising a pair of drums each having a transfer-sided positioning cylindrical surface at an outer peripheral portion, a drum coupling member for integrally coupling said pair of drums with each other at a predetermined separated, and a transfer-sided gear positioned at an outer periphery of at least one of said pair of drums; and a position adjusting apparatus for positioning said transfer drum close to, or apart from said photoconductive drum by moving said transfer drum supporting shaft;

wherein, both transfer-sided gear and transfer-sided positioning cylindrical surface are formed of an amorphous thermoplastic resin and when said transfer drum is positioned close to said photoconductive drum, said transfer-sided gear is meshed with said photoconductive-drum-sided gear, and said transfer-sided positioning cylindrical surface is abutted to said photoconductive-drum-sided positioning cylindrical surface, and further wherein said amorphous thermoplastic resin is at least one resin selected from the group consisting of polyarylate, polysulfone, polyetherimide, polyamidemide and polyethersulfone.

* * * * *

UNITED STATES PATENT AND TRADEMARK OFFICE

CERTIFICATE OF CORRECTION

PATENT NO. : 5,592,273

DATED : January 07, 1997

INVENTOR(S) : Keiji YAMAMOTO

It is certified that error appears in the above-indentified patent and that said Letters Patent is hereby corrected as shown below:

Claim 1, column 8, line 43, before "drum coupling", insert --a--.

Claim 5, column 10, line 12, "transfer-side" should read --transfer-sided--.

Claim 6, column 10, line 49, "add" should read --and--.

Claim 6, column 10, line 57, after "comprising", insert --a--.

Claim 7, column 11, lines 54-55, "comprising;" should read --comprising:--.

UNITED STATES PATENT AND TRADEMARK OFFICE

CERTIFICATE OF CORRECTION

PATENT NO. : 5,592,273

DATED : January 07, 1997

INVENTOR(S) : Keiji YAMAMOTO

It is certified that error appears in the above-indentified patent and that said Letters Patent is hereby corrected as shown below:

Claim 7, column 12, line 22, "tot he" should read --to the--.

Claim 8, column 13, line 12, "tot he" should read --to the--.

Claim 9, column 14, line 5, after "separated", insert --distance--.

Signed and Sealed this

Fifth Day of August, 1997

Bruce Lehman

*Attest:*

BRUCE LEHMAN

*Attesting Officer*

*Commissioner of Patents and Trademarks*